United States Patent [19]

Mizuno et al.

[11] Patent Number: 4,632,873

[45] Date of Patent: Dec. 30, 1986

[54] ULTRAFINE FIBER OF AN ETHYLENE TETRAFLUORIDE COPOLYMER AND A PROCESS FOR PRODUCING IT AND A POROUS MEMBRANE THEREOF

[75] Inventors: Toshiya Mizuno; Nobuhiro Moriyama; Naohiro Murayama; Shigeru Saitoh, all of Fukushima, Japan

[73] Assignee: Kureha Kagaku Kogyo Kabushiki Kaisha, Tokyo, Japan

[21] Appl. No.: 596,112

[22] Filed: Apr. 2, 1984

[30] Foreign Application Priority Data

Apr. 1, 1983 [JP] Japan ..... 58-55205
Apr. 1, 1983 [JP] Japan ..... 58-55206

[51] Int. Cl.[4] ..... D02G 3/00; B32B 27/00

[52] U.S. Cl. ..... 428/364; 428/903; 526/253; 526/245; 526/255; 526/247; 526/249

[58] Field of Search ..... 428/364, 401, 421, 422, 428/903

[56] References Cited

U.S. PATENT DOCUMENTS

| | | | |
|---|---|---|---|
| 3,372,082 | 3/1968 | Kometani et al. | 428/421 |
| 3,513,144 | 5/1970 | Kometani et al. | 428/364 |
| 4,187,390 | 2/1980 | Gore | 428/364 |
| 4,381,387 | 4/1983 | Sulzbach | 428/421 |

*Primary Examiner*—George F. Lesmes
*Assistant Examiner*—Beverly K. Johnson
*Attorney, Agent, or Firm*—Sughrue, Mion, Zinn, Macpeak, and Seas

[57] ABSTRACT

Ultrafine fiber of an ethylene tetrafluoride copolymer having an orientation degree ($\pi$) of at least 0.6 and an average fineness of 0.0001 to 0.9 denier. A process for producing such fiber or a porous membrane thereof is also disclosed.

2 Claims, 2 Drawing Figures

FIG. 1 (II)

ULTRAFINE FIBER OF AN ETHYLENE TETRAFLUORIDE COPOLYMER AND A PROCESS FOR PRODUCING IT AND A POROUS MEMBRANE THEREOF

BACKGROUND OF THE INVENTION

1. Field of the Invention

This invention relates to ultrafine fiber of an ethylene tetrafluoride copolymer having a high melting point. More particularly, it relates to fiber having an orientation degree ($\pi$) of at least 0.6 and an averae fineness of 0.0001 to 0.9 denier. This invention is also concerned with a process for producing such fiber or a porous membrane thereof by treating with a solvent fiber of the type composed of an ethylene tetrafluoride copolymer as an island component and a polyolefin as an ocean component.

2. Description of the Prior Art

It is known that a copolymer consisting mainly of ethylene tetrafluoride is excellent in various properties, including resistance to heat and chemicals, electrical insulating property, water or oil repelling property and mechanical properties. Ultrafine fiber of such a copolymer having a high degree of orientation or a porous membrane thereof is expected to be useful for a wide variety of industrial applications. It has, however, been very difficult to produce ultrafine fiber having an average fineness of 0.0001 to 0.9 denier and a high degree of orientation, since these copolymers have a high melting point and are not satisfactory in workability.

It is known that ulrafine fiber can be produced from, for example, a polyester or nylon, if it is extruded with, for example, polystyrene to form fiber of the type in which it defines an island component, while polystyrene constitutes an ocean component, and if the polystyrene is removed by a solvent, as disclosed in Japanese Unexamined Patent Specification No. 114773/1977. This method is applicable to a fiber-forming polymer such as a polyester or nylon, and based on the possibility of a chemical separation for a combination of a fiber-forming polymer having a high intermolecular cohesive force and soluble in a polar solvent and a polymer soluble in a nonpolar solvent, such as polystyrene. It is easy to find a thermally stable polymer which can be extruded with a known fiber-forming polymer, such as a polyester or nylon, since the extrusion of any such fiber-forming polymer does not require a very high temperature. The high intermolecular cohesive force of the fiber-forming polymer enables oneself to flow for satisfactory orientation during its extrusion with another polymer, such as polystyrene, and facilitates the formation of ultrafine fiber if it is given an ultrafine fibrous shape.

U.S. Pat. No. 3,099,067 discloses the production of ultrafine fiber of polytrifluorochloroethylene by removing polyethylene from mixed fiber containing polytrifluorochloroethylene as an island component and polyethylene as an ocean component. A copolymer consisting mainly of perfluoroethylene, such as ethylene tetrafluoride, however, has a high melting point and involves, therefore, a lot of difficulty in extrusion. The mere spinning of its mixture with polyethylene having a large melt index does not produce ultrafine fiber having a high degree of orientation. An ethylene tetrafluoride copolymer has a low intermolecular cohesive force, as opposed to the so-called fiber-forming polymer. Accordingly, it is very likely that, even if an apparently fibrous material may be formed, when it may not have a sufficiently high degree of orientation, it may not be useful fiber. Therefore, there has been no ultrafine fiber of ethylene tetrafluoride copolymer having a high degree of orientation.

A porous membrane of a fluorine-containing resin can be produced by various methods, for example:

(1) Dissolving a resin in a solvent, gelling its solution by cooling or otherwise, and removing the solvent (gelation method);

(2) Molding a mixture of a resin and a removable substance and removing the removable substance (mixing method);

(3) Stretching a molded resin product which is not homogeneous, for example, which has undergone crystallization or contains foreign matter (stretching method); or (4) Sintering the particles or fiber of a resin (sintering method).

The gelation method is, however, unsuitable for a copolymer of ethylene tetrafluoride, since an appropriate solvent is not easily available. As it is a relatively soft resin, the sintering method is also unsuitable as failing to form pores. The stretching or mixing method is, therefore, usually employed. The stretching method has, however, the disadvantage of forming an anisotropic membrane which is stiff and easy to tear. The production of a large membrane requires a large apparatus. The mixing method has the advantage of producing a fine porous membrane which is similar to paper or leather, but the disadvantage of forming a laminar product having a very low degree of permeability if a large molding machine, such as an extruder, is employed. This method is, therefore, used for only a limited scope of industrial application. In order to overcome this disadvantage, there has been proposed a method which comprises kneading a mixture of a thermoplastic resin and a fluorine-containing resin at a temperature below their melting points to effect its fibrilation and removing the thermoplastic resin, as disclosed in Japanese Patent Publication No. 8506/1974. If a fine powder is employed, this method enables the production of a membrane composed of very fine fibril, but as its kneading proceeds, its viscosity increases to the extent that it is practically impossible to continue kneading and obtain a dense membrane. Another disadvantage of this method is that the production of a large membrane requires a large apparatus.

A conventionally available fiber of an ethylene tetrafluoride copolymer having a diameter of several tens to hundreds of microns was relatively soft and difficult to handle. And if this fiber may be intertwined, due to its large diameter, the formation of a membrane having fine pores was difficult.

SUMMARY OF THE INVENTION

It is an object of this invention to provide ultrafine fiber of an ethylene tetrafluoride copolymer having a high degree of orientation. The fiber of this invention has an orientation degree ($\pi$) of at least 0.6 and an average fineness of 0.0001 to 0.9 denier.

It is another object of this invention to provide a process for producing ultrafine fiber of an ethylene tetrafluoride copolymer having an orientation degree ($\pi$) of at least 0.6 and an average fineness of 0.0001 to 0.9. This object is attained by a process which essentially comprises preparing a molten mixture of an ethylene tetrafluoride copolymer and a polyolefin having a melt index not exceeding 2, extruding it, spinning the extruded mixture to produce fiber containing the ethylene tetrafluoride copolymer as an island component and the polyolefin as an ocean component, and dissolving away the polyolefin with a solvent.

It is still another object of this invention to provide a process for producing a porous membrane having continuous pores from an ethylene tetrafluoride copolymer. This object is attained by a process which essentially comprises preparing a molten mixture of an ethylene tetrafluoride copolymer and a polyolefin having a melt index not exceeding 2, extruding it, spinning the extruded mixture to produce fiber containing the ethylene tetrafluoride copolymer as an island component and the polyolefin as an ocean component, intertwining the fiber, and dissolving away the polyolefin with a solvent. The spun fiber has an appropriate diameter for easy intertwining to produce an intertwined product having a desired size. The fiber of the ethylene tetrafluoride copolymer obtained by the removal of the polyolefin is ultrafine in the range of about 0.01 to 5 microns in diameter. The cohesive force of its intertwined product facilitates the production of a porous membrane having very fine pores and a large area which has hitherto not been obtained.

BRIEF DESCRIPTION OF THE DRAWING

FIG. 1(I) is a wide-angle X-ray photograph of the fiber obtained in EXAMPLE 1.

DETAILED DESCRIPTION OF THE INVENTION

Figure 1:
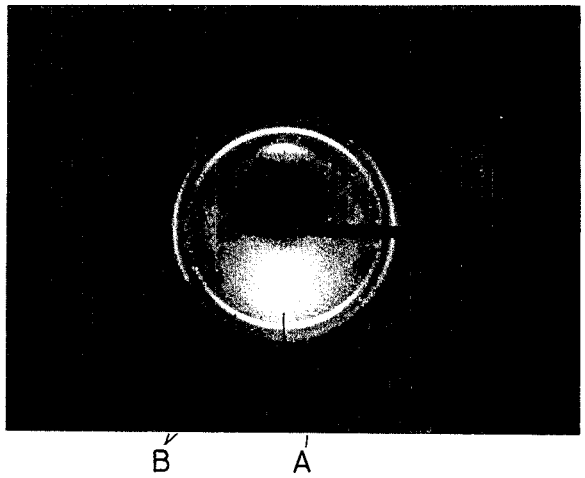
FIG. 1(II) is a similar photograph showing the fiber obtained in COMPARATIVE EXAMPLE 1.
Figure 1:
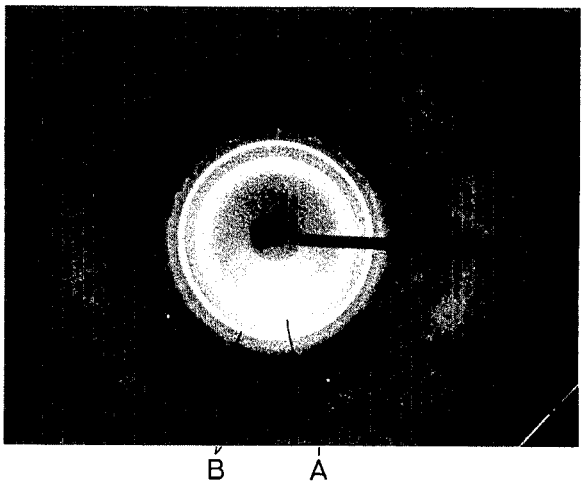

The fiber of this invention is formed from a copolymer consisting mainly of ethylene tetrafluoride. It is preferable to use a copolymer containing at least 60% by weight of ethylene tetrafluoride and not more than 40% by weight of a fluorine-containing ethylenic monomer which is copolymerizable with ethylene tetrafluoride. Examples of the monomer which can be used include hexafluoropropylene, perfluoroalkyl vinyl ether, perfluoroalkyl acrylate, vinyl fluoride, vinylidene fluoride, trifluoroethylene and trifluorochloroethylene. It is particularly preferable to use, for example, hexafluoropropylene, perfluoroalkyl vinyl ether or perfluoroalkyl acrylate so that the advantages of the fluorine-containing resin may be fully utilized. The copolymer preferably has a melt viscosity in the range of $1\times10^3$ to $8\times10^5$ poise, more preferably $5\times10^3$ to $5\times10^5$ poise at 320° C. and a contact angle of at least 95°, more preferably at least 100°, with water at 25° C. If its melt viscosity is too high, it is difficult to obtain fiber of the desired structure in which the copolymer constitutes an island component, while too low melt viscosity results in the likelihood that the advantages of fluorine-containing resin may be lost. If its angle of contact with water is smaller than 95°, the resulting fiber is low in water or oil repelling property and has a narrower scope of application.

A salient feature of this invention resides in the selection of a thermoplastic resin which is mixed with the ethylene tetrafluoride copolymer and forms an ocean component in the fiber structure. It is essential to use a thermoplastic resin which has a sufficiently high thermal stability for forming a molten mixture with an ethylene tetrafluoride copolymer having a high melting point and a high melt viscosity, a melt viscosity substantially equal to that of the copolymer and a sufficient affinity for micromixing with the copolymer when melted, though it is not compatible therewith, which can be dissolved in an ordinarily available solvent, and which facilitates the orientation of the copolymer at a high degree when the molten mixture is extruded and spun.

The inventors of this invention have tested a lot of thermoplastic resins and found that a polyolefin having a melt index not exceeding 2 satisfies the requirements as hereinabove set forth. If this melt index requirement is met, it is possible to use any known polyolefin, such as polyethylene, polypropylene, a copolymer consisting mainly of ethylene or propylene, polyisoprene or polybutylene, or a mixture thereof. Polyethylene and polypropylene are particularly preferred in view of their good properties and relative inexpensiveness.

According to this invention, it is preferable to use a polyolefin which shows a weight reduction rate not exceeding 0.05% by weight per minute in a nitrogen atmosphere having a temperature of 350° C. Polystyrene, polymethyl methacrylate and other polyolefins which are used to form an ocean component in ordinary fiber of the ocean and island structure are unsuitable for use in accordance with this invention, since they have a high weight reduction rate and are thermally unstable.

A polyolefin having a melt index not exceeding 2, and preferably in the range of 1 to 0.01, has a high melt viscosity and can be micromixed with an ethylene tetrafluoride copolymer to form fiber of the ocean and island structure by extrusion and spinning. A polyolefin having a melt index exceeding 2 has a low crystalline melting point and a very high degree of fluidity at or above that temperature. Its melt viscosity is so low that it lacks sinnability during extrusion and fails to produce satisfactory fiber of the ocean and island structure. Even if fiber of such structure having a very fine diameter may be obtained, it is of inferior quality, since the polyolefin fails to provide a high degree of orientation for the ethylene tetrafluoride copolymer. For the purpose of this invention, the melt index of the polyolefin has been determined in accordance with the method specified by JIS (Japanese Industrial Standard) K-760.

The high orientation of ethylene tetrafluoride copolymer fiber according to this invention is apparently due to the strong interaction of the ethylene tetrafluoride copolymer which takes place with the stretching of the polyolefin. The fiber has an orientation degree ($\pi$) of at least 0.6. It was calculated from the half-band width obtained from an X-ray diffraction photograph of the fiber prior to the removal of the polyolefin. More specifically, a diffraction arc indicating the reflection of the ethylene tetrafluoride copolymer was found from a wide-angle X-ray diffraction photograph, the half-band width $\Delta\theta$ of intensity distribution along the arc was obtained, and the degree of orientation was calculated from the half-band width, as follows:

$$\pi = \frac{180 - \Delta\theta}{180}$$

The ethylene tetrafluoride copolymer and the polyolefin are mixed in a ratio which enables the copolymer to form an island structure and be recovered in a sufficient quantity in the form of ultrafine fiber upon removal of the polyolefin. More specifically, they may have a mixing ratio by weight in the range of 1 (copolymer): 0.05 to 2.5 (polyolefin), preferably 1:0.3 to 2.0. A higher polyolefin proportion results in a smaller fiber length and a lower degree of efficiency, while a lower polyolefin proportion results in the failure to produce uniformly fine fiber due to, for example, sticking.

Both the ethylene tetrafluoride copolymer and the polyolefin may be mixed in the form of powder or pellets. Their mixture is melted under heat, kneaded, extruded and spun to form fiber. Although any method can be used for melting and kneading the mixture if it is satisfactorily melted and kneaded, it is usually convenient to knead the mixture under heat in an extruder and extrude it into pellets. The extruder may usually have a die temperature of 280° C. to 360° C. The thus oriented resin mixture is spun by an ordinary spinning machine to form fiber having a fineness of, say, 30 to 300 denier. The spun fiber is wound at a high speed. It is advisable to employ a draft ratio of 100 to 5000 to obtain satisfactorily stretched, long fiber. The use of a lower draft ratio results in the failure of the ethylene tetrafluoride copolymer to be satisfactorily stretched and oriented. This means the failure to produce satisfactorily fine fiber having a desired length, and its low degree of orientation means its low strength. The fiber can be cold stretched into a more improved fineness, if required.

The polyolefin is, then, removed from the fiber by a solvent which can fully dissolve away the polyolefin, but in which the ethylene tetrafluoride copolymer is insoluble. The removal of the polyolefin can be satisfactorily carried out at an ambient temperature or at an elevated temperature up to 200° C. Although the solvent depends on the temperature at which the polyolefin is removed, it is possible to use, for example, an aliphatic, alicyclic or aromatic hydrocarbon, a halogenated aliphatic, alicyclic or aromatic hydrocarbon, or an aliphatic ester, ketone or diacyl ether having a total of at least eight carbon atoms. Specific examples of the preferred solvents include tetrachloroethylene for use at a temperature of at least 40° C., paraxylene, orthoxylene or metaxylene for use at a temperature of at least 60° C., n-butyl acetate for at least 100° C., diphenyl ether, tripalmitin, tetralin, diphenyl oxide, diphenyl, n-hexane, 1-dodecanol, n-decanol, anisole, nonylphenol, octylphenol, n-octanol, benzyl phenyl ether, p-tertiary amyl alcohol, nitrobenzene or dibutyl phthalate for at least 110° C., and squalene or glycol dipalmitate for at least 150° C. The time for dissolving away the polyolefin depends on the solvent and the temperature. The ultrafine fiber of the ethylene tetrafluoride copolymer obtained by the complete removal of the polyolefin is washed with, for example, acetone or benzene.

In order to produce a porous membrane in accordance with this invention, the fiber is intertwined into, for example, woven or knitted cloth or a nonwoven fabric prior to the removal of the polyolefin. The term "intertwine" as herein used has a wide meaning, and not only refers to a nonwoven fabric, but also includes weaving or knitting by a known method. As the fiber has a relatively large diameter prior to the removal of the polyolefin, it is easy to form an intertwined product having a large area. The polyolefin is removed from the intertwined product by using any of the solvents hereinbefore listed by way of example to yield a porous membrane of the ethylene tetrafluoride copolymer having continuous pores.

It is advisable to intertwine the fiber as densely as possible to produce a uniformly porous membrane, since an uneveness or clearance due to fiber diameter is necessarily likely to develop during the weaving, knitting or other intertwining operation. The inventors have found that it is possible to obtain a very densely intertwined product and eventually a uniformly porous membrane if the intertwined product is heat treated at a temperature which is at least equal to the melting point of the polyolefin, but lower than that of the ethylene tetrafluoride copolymer. Although the reason is not clear, it is probable that the heat treatment of the intertwined fiber may promote its fusion and densification to enable the mutual contact of the ultrafine fiber of the ethylene tetrafluoride copolymer upon removal of the polyolefin, and that the copolymer having a very clean surface may have a strong cohesive force to fill any clearance easily. It is preferable to carry out such heat treatment under pressure in order to ensure that a densely intertwined product be obtained.

The porous membrane obtained by the removal of the polyolefin from the intertwined product is washed with, for example, acetone or benzene. The porosity and pore diameter of the membrane and its pore diameter distribution depend on, for example, the fineness and proportion of the ethylene tetrafluoride copolymer fine fiber in the mixed fiber, and the degrees of intertwining and heat treatment. It is necessary to take these factors into account in order to produce a porous membrane having a porosity, a pore diameter and its distribution which are desired.

The fiber of this invention is ultrafine and excellent in water and oil repelling properties. It is, therefore, useful for making, for example, a nonwoven fabric which is very soft and flexible and repels water and oil. This fabric is useful for making, for example, sportswear which is excellent in gas and water vapor permeability, water drop imperviousness and resistance to contamination by, for example, sweat. The fabric is also useful for making a carpet which is excellent in contamination resistance and easy to clean even if it may be contaminated to some extent. Another useful application of the fabric lies in the fabrication of an air filter which maintains its excellent performance for a long period of time and is easy to clean for reuse. A mat formed from the ultrafine fiber of this invention provides a filter cloth which is useful for a wide variety of industrial and medical filtration purposes, since it is resistant to virtually any and all chemicals.

The porous membrane of this invention has a lot of similar advantages, including strength, porosity, gas permeability, water and oil repelling properties and contamination resistance. These features render it useful for a wide variety of applications, including the fabrication of industrial filters, all-weather type and other general clothings and medical membranes.

The invention will now be described more specifically with reference to several examples thereof.

EXAMPLE 1

One kilogram of an ethylene tetrafluoride copolymer in the form of pellets was mixed with 1 kg of pellets of a polyolefin. The copolymer was a copolymer of tetrafluoroethylene and hexafluoropropylene having a melt viscosity of $2\times10^4$ poises at 320° C. and a contact angle of 108° with water (product of du Pont known as Teflon FEP #100). The polyolefin was polyethylene having a melt index of 0.04 and weight reduction rate of 0.008% by weight per minute in a nitrogen atmosphere having a temperature of 350° C. (product of SHOWA DENKO K.K., Japan known as SHOWREX 2010HF). The mixture was pelletized by an extruder having a gradually increasing temperature of 250° C., 270° C., 300° C. and 330° C. from its hopper to its die and a die temperature of 340° C. The pelletization was repeated twice in the same way.

The resulting pellets were spun at 320° C. through nozzles having a diameter of 1 mm at a draft ratio of 200 to yield mixed fiber having an average fineness of 60 denier. The fiber was treated at 120° C. for three hours with paraxylene which was a solvent for polyethylene. The fiber removed from the solvent was treated again at 120° C. for an hour with fresh paraxylene. The fiber was, then, removed from the solvent, and immersed in benzene and in acetone. The fiber removed from acetone was dried to provide ultrafine FEP fiber which was purely white, soft and cottony.

The examination of the fiber through a microscope indicated that it was a mass of fiber having a fineness of, say, 0.1 to 1 micron, or 0.00016 to 0.016 denier. The X-ray diffraction of the fiber revealed that it had an orientation degree ($\pi$) of 0.92. Its X-ray photograph is shown in FIG. 1(I), in which an innermost layer A is a diffraction pattern showing the reflection due to FEP crystal, while an outer layer B is a diffraction pattern showing the reflection due to polyethylene.

EXAMPLES 2 AND 3 AND COMPARATIVE EXAMPLE 1

The procedures of EXAMPLE 1 were repeated for pelletization, except that Teflon FEP #100 was mixed with different grades of polyethylene having different melt indexes as shown in TABLE 1.

TABLE 1

| | Polyethylene | | | Teflon FEP #100 | |
|---|---|---|---|---|---|
| | MI | Weight reduction at 350° C. %/min. | Draft ratio | Fineness (Denier) | Degree of orientation ($\pi$) |
| EXAMPLE 2 | 0.35 | 0.01 | 180 | 0.01 max. | 0.88 |
| EXAMPLE 3 | 1 | 0.009 | 150 | 0.02 max. | 0.80 |
| COMPARATIVE EXAMPLE 1 | 7 | 0.04 | 80 | 1.8 max. | 0.51 |

The pellets were spun through nozzles having a diameter of 0.5 mm. Sufficiently drafted mixed fiber was obtained at a die temperature of 300° C. to 330° C. from the pellets containing polyethylene having a melt index (MI) of 0.35 (EXAMPLE 2) and also from the pellets containing polyethylene having a melt index of 1 (EXAMPLE 3). The procedures of EXAMPLE 1 were repeated for the solvent treatment of the fiber for polyethylene removal to yield FEP fiber having the fineness and orientation degree shown in TABLE 1 for each of EXAMPLES 2 and 3.

The pellets containing polyethylene having a melt index of 7 were likewise spun, but failed to produce any acceptable fiber. Only seriously broken fiber could be obtained. The die temperature was, therefore, lowered to 280° C. and the pellets were spun at a draft ratio of 80. It was, however, still difficult to produce substantially uniform fiber. The fiber was likewise treated for polyethylene removal. The fineness and orientation degree of the FEP fiber thereby obtained are shown in TABLE 1 (COMPARATIVE EXAMPLE 1). An X-ray photograph of the FEP fiber of COMPARATIVE EXAMPLE 1 is shown in FIG. 1(II). As is obvious therefrom, it was unsuitable fiber not having any satisfactory degree of orientation.

EXAMPLE 4

Two kilograms of the same copolymer as used in EXAMPLE 1 were mixed with 2 kg of the same polyolefin as used in EXAMPLE 1. The mixture was pelletized by an extruder having a die temperature of about 330° C. The pelletization was repeated to obtain improved kneading results. The mixed Teflon and polyethylene pellets were, then, spun through nozzles having a diameter of 0.5 mm at a draft ratio of 200 and a nozzle temperature of 320° C. to yield mixed fiber having a diameter of about 60 microns.

The fiber was cut into fragments having a length of several centimeters. The fragments were uniformly scattered and intertwined to form a nonwoven fabric having a fiber density of 0.8 g per 100 $cm^2$. The fabric was pressed by a hot press at a temperature of 140° C. and a pressure of 0.2 $kg/cm^2$. The polyethylene was thereby fused to yield a sheet.

The sheet was immersed for about two hours in paraxylene at 120° C., whereby polyethylene was removed therefrom. In order to ensure the complete removal of polyethylene, the sheet was immersed again in fresh paraxylene at 120° C. for 30 minutes. The sheet removed from the solvent was washed with benzene and acetone, and dried to yield a porous membrane.

The examination of the membrane through a microscope indicated that it was composed of numerous masses of intertwined fiber having a diameter of about one micron. The membrane was inclined at an angle of about 15° to the horizontal, and water drops were dropped on the membrane from a height of about 15 cm. All the water drops fell down without adhering to or penetrating the membrane. The membrane showed a gas permeability not exceeding 1 sec./100 cc upon examination in accordance with the method of JIS P-8117B. The X-ray diffraction of the fiber prior to intertwining indicated an orientation degree ($\pi$) of 0.92.

What is claimed is:

1. An ultra-fine fiber comprising an ethylene tetrafluoride copolymer, said copolymer comprising an ethylene tetrafluoride monomer copolymerized with a fluorine-containing ethylenic monomer, wherein said fiber has an orientation degree ($\pi$) of at least 0.6 and an average fineness of 0.0001 to 0.9 denier.

2. The fiber as set forth in claim 1, wherein said copolymer is composed of ethylene tetrafluoride and a perfluoro fluorine monomer.

* * * * *